United States Patent [19]

Uchinami et al.

[11] Patent Number: 4,886,028

[45] Date of Patent: Dec. 12, 1989

[54] APPARATUS FOR CONTROLLING AIR-FUEL RATIO OF INTERNAL COMBUSTION ENGINE

[75] Inventors: Masanobu Uchinami; Toshihisa Takahashi; Hiroyoshi Suzuki; Ryoji Nishiyama; Shinichi Nishida, all of Hyogo, Japan

[73] Assignee: Mitsubishi Denki Kabushiki Kaisha, Tokyo, Japan

[21] Appl. No.: 310,571

[22] Filed: Feb. 15, 1989

[30] Foreign Application Priority Data

Feb. 26, 1988 [JP] Japan ..... 63-45133

[51] Int. Cl.[4] ..... F02D 41/14; F02D 41/22

[52] U.S. Cl. ..... 123/479; 123/489

[58] Field of Search ..... 123/440, 489, 479; 204/401, 406

[56] References Cited

U.S. PATENT DOCUMENTS

| | | | |
|---|---|---|---|
| 4,724,814 | 2/1988 | Mieno et al. | 123/479 |
| 4,724,815 | 2/1988 | Mieno et al. | 123/479 |
| 4,753,203 | 6/1988 | Yamada | 123/479 X |
| 4,777,922 | 10/1988 | Mieno et al. | 123/479 |
| 4,819,602 | 4/1989 | Mieno et al. | 123/479 |

*Primary Examiner*—Tony M. Argenbright

*Attorney, Agent, or Firm*—Sughrue, Mion, Zinn, Macpeak and Seas

[57] ABSTRACT

An air-fuel ratio control apparatus for an internal combustion engine comprises feedback control of the air-fuel ratio control, wherein a pump-driving voltage for flowing a pump-driving current is lowered to a predetermined value, and feedback control is suspended when the pump-driving current becomes lower than a predetermined value.

2 Claims, 6 Drawing Sheets

APPARATUS FOR CONTROLLING AIR-FUEL RATIO OF INTERNAL COMBUSTION ENGINE

BACKGROUND OF THE INVENTION

1. Field of the Invention:

This invention relates to an apparatus for controlling the air-fuel ratio of an internal combustion engine.

2. Prior Art:

Devices for detecting the air-fuel ratio of an internal combustion engine have previously been known. Such devices comprise a wide range air-fuel ratio sensor including an oxygen sensor section which generates an electromotive force in response to the difference between atmospheric pressure and the oxygen concentration in exhaust gas discharged from the engine, and an oxygen pump section which provides a pump-driving current to feed and discharge oxygen to and from the exhaust gas used for comparison with the atmospheric pressure, the flow of the pump-driving current being controlled so that the output voltage of the oxygen sensor attains a predetermined value, whereby the air-fuel ratio of the engine is detected from the magnitude of the pump-driving current (see, for example, Japanese Utility Model Public Disclosure No. 18659/1987). Thus, control of the air-fuel ratio of the engine is carried out by using such a device to detect the air-fuel ratio. The above-mentioned device can continuously measure the air-fuel ratio over a wide range from rich to lean.

In a conventional apparatus for controlling air-fuel ratio, as mentioned above, the pump-driving current is fed so that the output voltage of the oxygen sensor section is kept constant, and the air-fuel ratio is detected by measuring the pump-driving current. However, if any deterioration due to aging (secular change) or the like occurs in the oxygen sensor section or the oxygen pump section, the characteristics will deviate from their initial normal values and thus correct information on the air-fuel ratio cannot be obtained. This has led to the problem, that if the feedback control of the air-fuel ratio is conducted in response to the operation of the wide range air-fuel ratio sensor when the latter is malfunctioning, the air-fuel ratio will be greatly affected such as to produce an excessively rich or lean mixture, resulting in poor performance, deterioration of the exhaust gas quality and possibly even stalling of the engine.

SUMMARY OF THE INVENTION

It is therefore an object of the present invention to solve the above-mentioned problems and to provide an apparatus for controlling the air-fuel ratio of an internal combustion engine, said apparatus being arranged to avoid any possibility of a lowering of the engine performance, deterioration in the quality of the exhaust gas, or stalling of the engine.

According to the present invention, there is provided an apparatus for controlling the air-fuel ratio of an internal combustion engine comprising a deterioration detecting means for detecting any deterioration in the performance of a wide range air-fuel ratio sensor when the pump-driving current becomes lower than a predetermined value due to the pump-driving voltage being changed to a predetermined value which is lower than the ordinary pump-driving voltage driving operation of the engine in a steady condition at which time the air-fuel ratio is within a predetermined range, and a feedback interrupting means for suspending the feedback control of the air-fuel ratio when such a deterioration is detected.

The significance of the invention and other objects and advantages thereof will become more apparent from the detailed description of a preferred embodment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
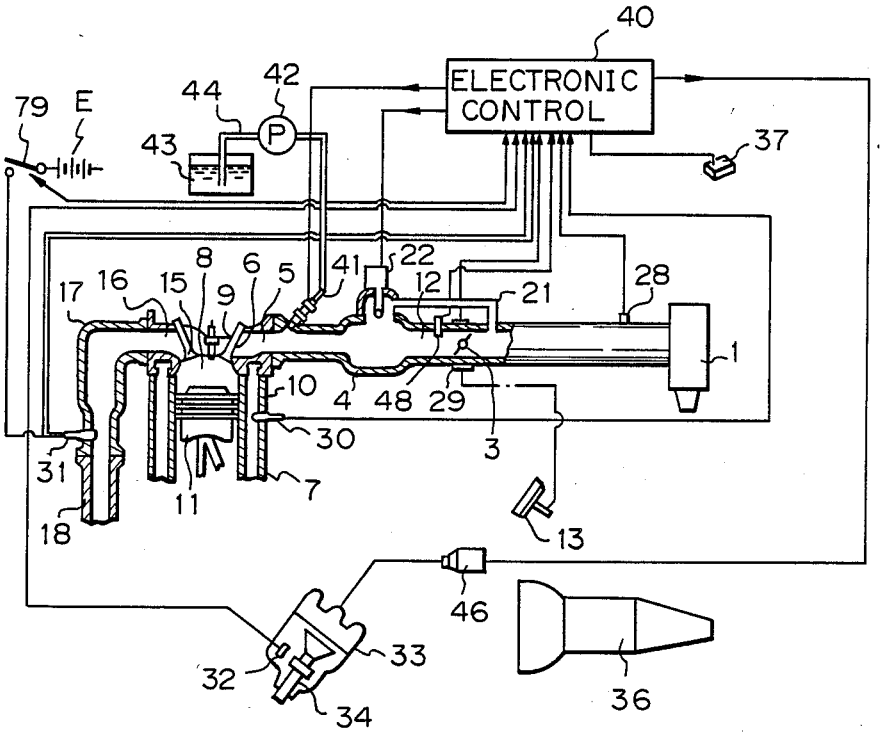
FIG. 1 is a schematic illustration of an apparatus in accordance with the present invention.

Referring to FIG. 1, the air sucked through an air cleaner 1 is fed to a combustion chamber 8 in an engine block 7 through a suction passage 12 including a throttle valve 3, a surge tank 4, a suction port 5 and a suction valve 6. Provided in the suction passage 12 is a negative pressure sensor 48 which is connected to an electronic control unit 40. The throttle valve 3 is interlocked with an accelerator pedal 13 provided in the driver's compartment of the vehicle. The combustion chamber 8 is defined by a cylinder head 9, a cylinder block 10 and a piston 11, and the exhaust gas generated therein by the combustion of the fuel-air mixture is discharged to the atmosphere through an exhaust valve 15, an exhaust port 16, an exhaust manifold 17 and an exhaust pipe 18. A bypass passage 21 is provided to communicate the upstream portion of the throttle valve 3 with the surge tank 4, and a valve 22 for controlling the rate of bypass flow is also provided to control the cross-sectioned area of the bypass passage 21, thereby maintaining the engine speed at a constant value during idling operation. An intake-air temperature sensor 28 is provided in the suction passage 12 to detect the temperature of the intake air, and a throttle position sensor 29 serves to detect the degree of opening of the throttle valve 3. Further, a water temperature sensor 30 is mounted on the cylinder block 10 to detect the temperature of the cooling water, and a device 31 for detecting the air-fuel ratio is mounted at the junction of the exhaust manifold 17 and connected to a battery E through a switch 79 to detect the air-fuel ratio at the junction. A crank angle detecting sensor 32 is provided to detect the crank angle and rotational speed of the crank by measuring the rotation of a shaft 34 of a distributor 33 connected to the crank shaft of the engine block 7. A reference numeral 36 in FIG. 1 designates a transmission.

The outputs of the intake-air temperature sensor 28, the throttle position sensor 29, the water temperature sensor 30, a battery 37, a negative pressure sensor 48, the air-fuel ratio detecting device 31 and the crank angle sensor 32 are fed to an electronic control unit 40. Fuel injection valves 41 corresponding to each of the cylinders are disposed adjacent to each suction port 5, and a pump 42 serves to supply fuel from a fuel tank 43 through a fuel passage 44 to the fuel injection valve 41. The electronic control unit 40 calculates the rate at which the fuel is injected by utlizing as parameters the input signals from the respective sensors and delivers to the fuel injection valve 41 an electric pulse having a width corresponding to the calculated fuel injection rate, whereby the fuel injection valve is opened in accordance with the pulse width representing the fuel injection rate.

The electric control unit 40 also controls the bypass flow control valve 22 and an ignition coil 46, the secondary side of which is connected to the distributor 33.

The system of the electronically controlled injection type engine shown in FIG. 1 is a D-Jetronic (speed density) type fuel injection system in which a basic injection pulse time period is calculated at least on the basis of the output values of the negative pressure sensor 48 and the engine rotation detecting sensor 32, and the basic injection pulse time period is then subjected to correction on the basis of the signal from the intake air temperature sensor 28, a transistory correction, a feedback correction effected by the air-fuel sensor and so forth, whereby the fuel injection allowed through the fuel injection valve 41 is given a target air-fuel ratio.

Figure 2:
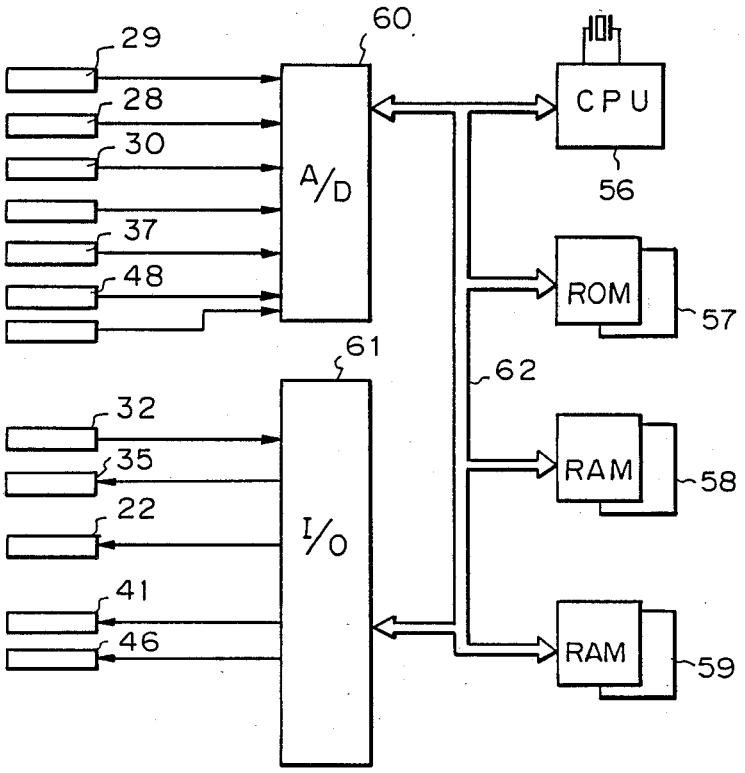
FIG. 2 is a block diagram of a electronic control section incorporated in the apparatus of the invention.

FIG. 2 is a block diagram showing the detail of the electronic control unit 40. The control unit 40 comprises a CPU (central processing unit) 56 including a microprocessor for effecting operation and control, a ROM (read-only memory) 57 for providing a program for the correction process as mentioned below, and other programs for the bypass flow control process and so forth, a first RAM 58 for temporarily storing data obtaining during the operation, a second RAM 59 as a non-volatile memory supplied with power from an auxiliary power source and adapted to hold necessary data in its memory even when the engine is not in operation, an A/D (analog-to-digital) converter 60, an I/O (input-/output) device 61 and a bus 62. The outputs of the throttle position sensor 29, the negative pressure sensor 48 the intake-air temperature sensor 28, the water temperature sensor 30, the air-fuel ratio detecting device 31 and the baterry 37 are supplied to the A/D converter 60. The output of the crank angle sensor or rotational speed sensor 32 is supplied to the I/O device 61. The bypass flow control valve 22, a pump-driving voltage switching circuit 35, the fuel injection valve 41 and the ignition coil 46 are supplied with inputs from the CPU 56 throough the I/O device 61.

An example will be described below of the way in which the fuel supply system is controlled using the abovedescribed electronic control unit 40 to calculate a target air-fuel ratio and, after correcting the target air-fuel ratio, to provide a corrected target air-fuel ratio. The program for executing such a process is stored in the ROM 57.

Figure 3:
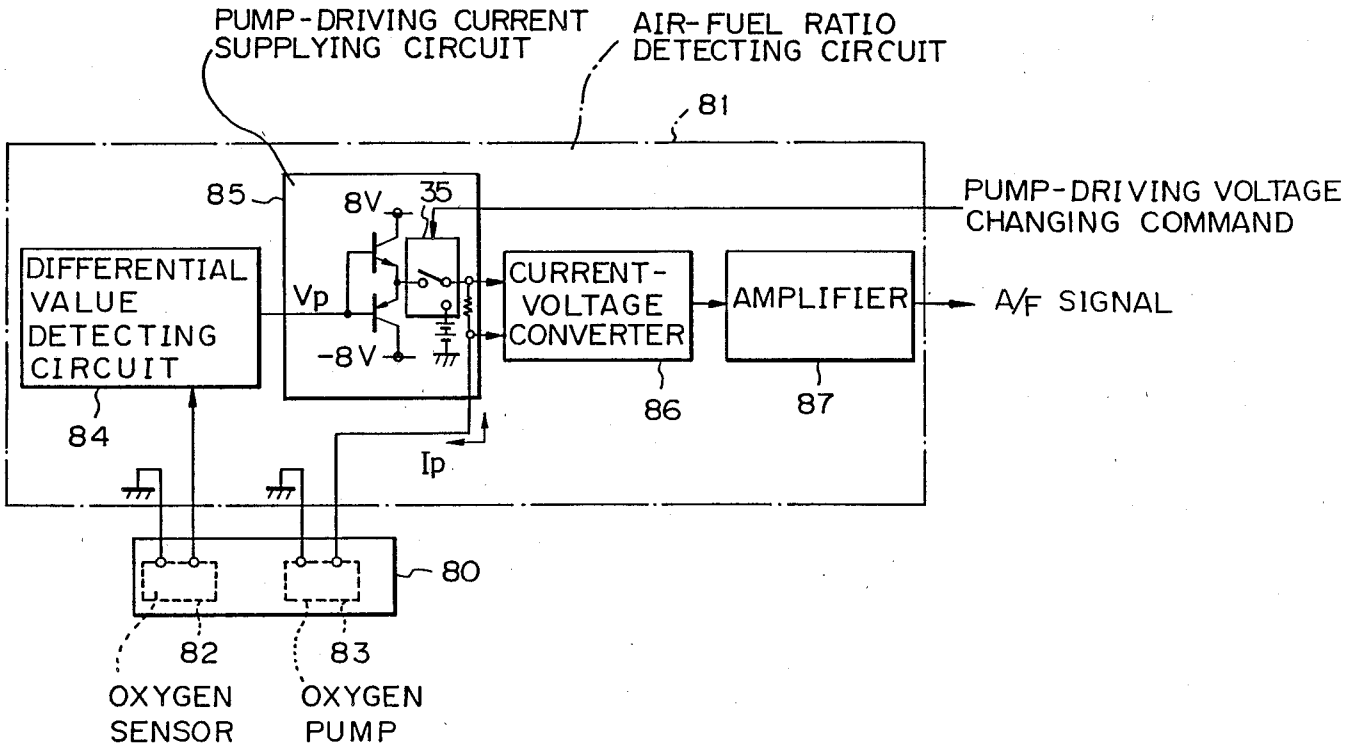
FIG. 3 is a block diagram of an apparatus for detecting the air-fuel ratio incorporated in the apparatus of the invention.

FIG. 3 shows an arrangement of the air-fuel ratio detecting device 31 comprising a wide range air-fuel ratio sensor 80 and an air-fuel ratio detecting circuit 81. The wide range air-fuel ratio sensor 80 includes solid-electrolyte oxygen sensor section 82 for generating electromotive force in accordance with the difference between the atmospheric pressure and the oxygen concentration of the engine exhaust gas and a solid-electrolyte oxygen pump section 83 for flowing a pump-driving current so that the output voltage of the oxygen sensor section 82 attains a predetermined value. The air-fuel ratio detecting circuit 81 includes a circuit 84 for detecting a differential value representing the difference between the reference value and the electromotive force of the oxygen sensor 82, pump-driving current supplying circuit 85 including the pump-driving voltage switching circuit 35, a current-voltage converting circuit 86 and a voltage amplifying circuit 87.

The operation of the air-fuel ratio detecting device 31 shown in FIG. 3 is described below. The differential value detecting circuit 84 detects the difference between the output of the oxygen sensor section 82 and the reference voltage and supplies this differential signal to the pump-driving current supplying circuit 85 which, in turn, supplies a pump-driving current $I_P$ in accordance with the differential signal to the oxygen pump section 83. Thus, oxygen is supplied and feedback control is conducted so that the output of the oxygen sensor section 82 is changed to correspond to the reference value. The amount of oxygen conveyed by the pump-driving current $I_P$ corresponds to the air-fuel ratio. Then, the pump-driving current $I_P$ is converted by the conversion circuit 86 to a voltage which is, in turn, amplified by the amplifier circuit 87 and supplied as an air-fuel ratio signal (A/F signal) to the electronic control unit 40. The pump-driving voltage switching circuit 35 also receives a pump-driving voltage changing command from the electronic control unit 40.

Figure 4:
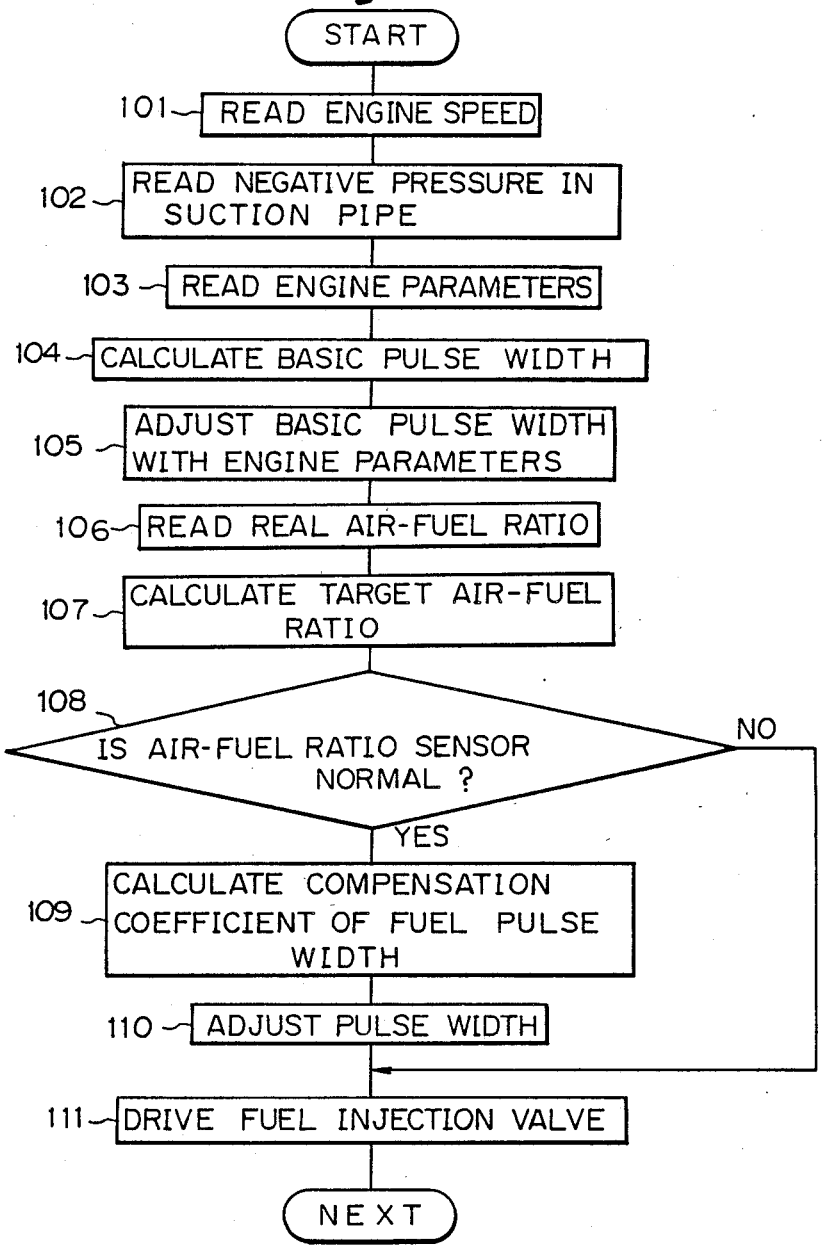
FIGS. 4 and 5 are flow charts showing the operation of the apparatus of the invention.

The operation of the air-fuel ratio control apparatus of FIG. 1 will be described below by reference to the flowchart shown in FIG. 4. At steps 101 to 103, the conditional parameters of the engine, such as the engine speed, the negative pressure in the suction pipe, the water temperature, and the intake-air temperature, are read out. At step 104, the basic pulse width for driving the fuel injection valve 41 is computed in accordance with the engine speed and suction pipe pressure read out in step 101 and 102. At step 105, the basic pulse width is adjusted in accordance with the conditional parameters such as values for the water temperature, intake-air temperature, etc. The real air-fuel ratio signal from the air-fuel ratio detecting device 31 is read in step 106, a target air-fuel ratio is calculated in step 107, and a decision is made as to whether or not the wide range air-fuel ratio sensor 80 is normally operative in step 108. If the sensor 80 is decided to be in a normal state, a compensation coefficient in respect of the fuel pulse width is calculated in accordance with the deviation of the real air-fuel ratio from the target ratio in step 109, the pulse width is adjusted by the calculated compensation coefficient in step 110, and the fuel injection valve 41 is driven in accordance with the adjusted pulse width in step 111. In step 108, if the wide range air-fuel ratio sensor 80 is decided not to be in a normal condition, the operation proceeds to step 111 at which the fuel injection valve 41 is driven in accordance with the pulse width calculated in step 105 and the preceding steps.

Figure 5:
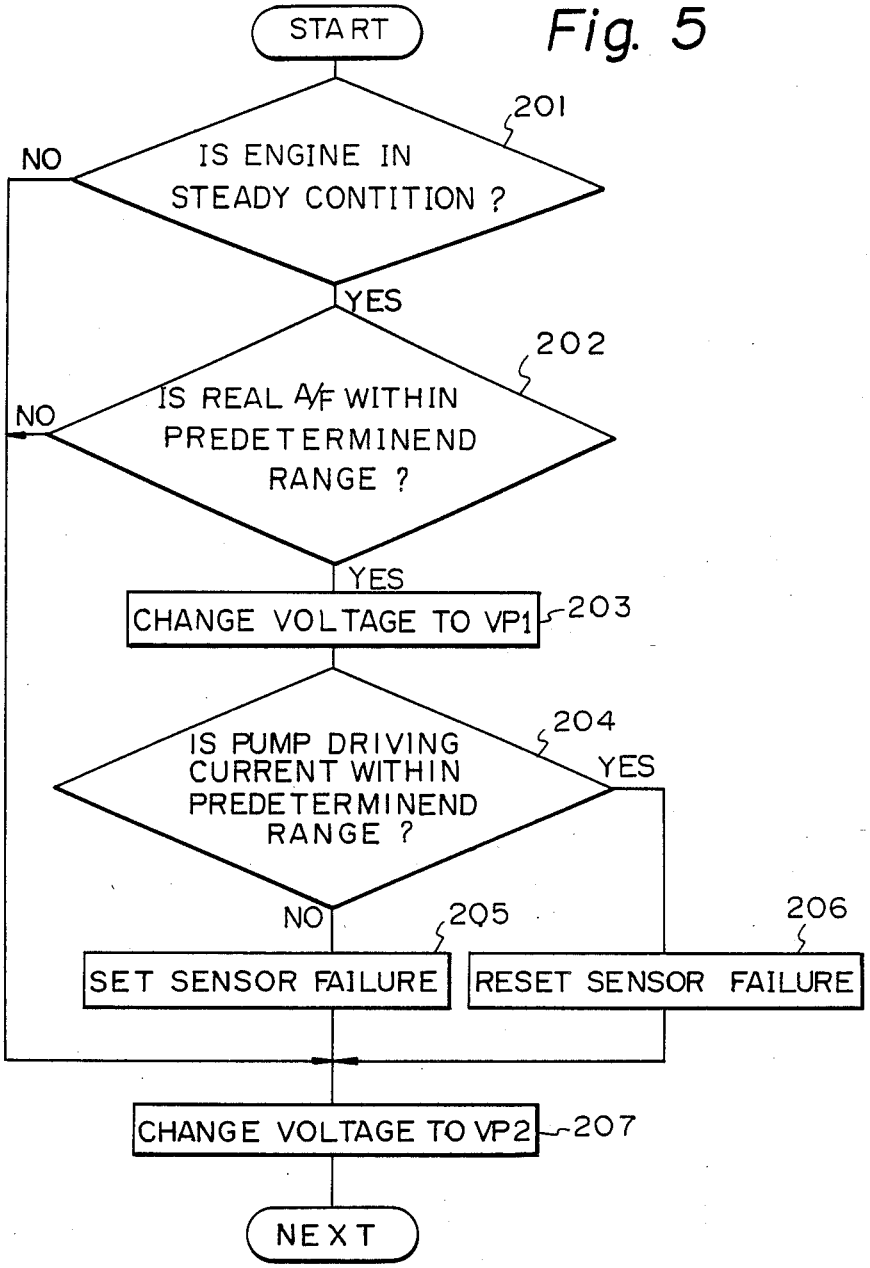

The deterioration detecting routine in step 108 will now be described in more detail by reference to the flowchart shown in FIG. 5. In step 201, a decision is made as to whether or not the engine is in its steady condition. This decision is made, for example, by judging whether or not the value of the negative pressure in the suction pipe is greatly different from the previous value. In step 202, a decision is made as to whether or not the real air-fuel ratio read out in step 106 is within a predetermined range. f not, it is presumed that driving state is not suitable for detecting whether there is a state of deterioration, and the operation proceeds to step 207.

Figure 6:
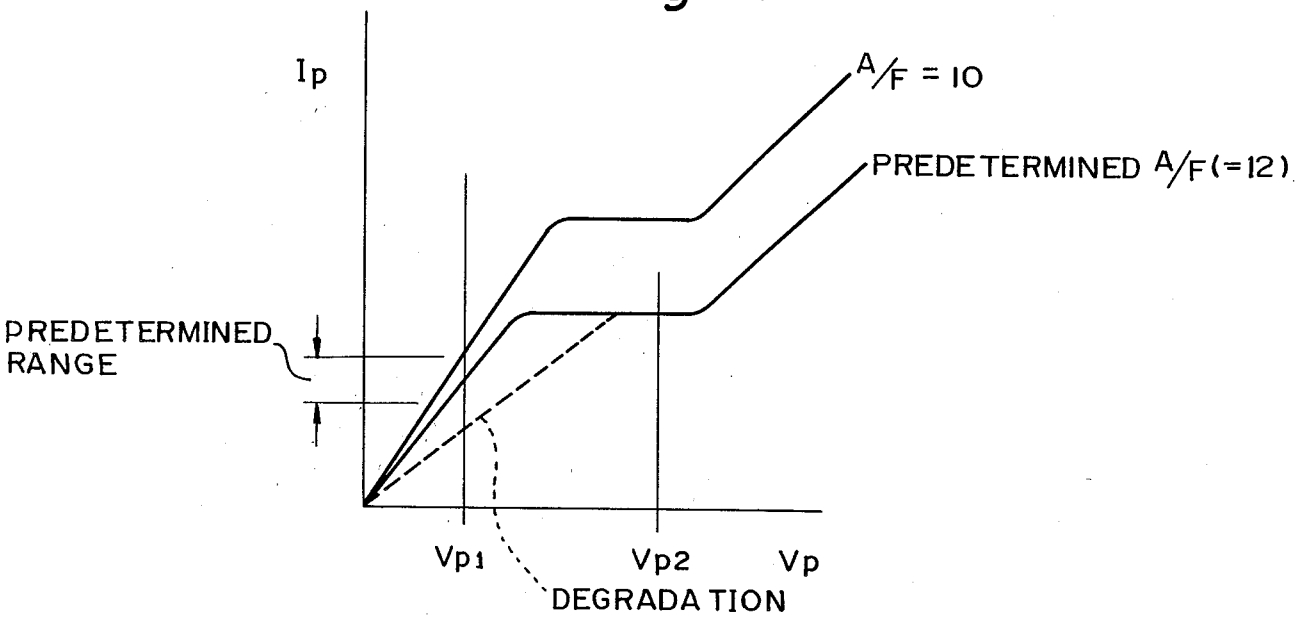
FIG. 6 is a graph showing the relationship between the pump-driving current and voltage to assist in explaining the operation of detecting the degradation any deterioration in the performance of a sensor.

If the engine is in the steady condition and the air-fuel ratio is in the predetermined range, in step 203, the pump-driving voltage switching circuit 35 (FIG. 3) is operated by a pump-driving voltage changing command to change the pump-driving voltage to a constant value $V_{P1}$ lower than the normal control value (limit current point) $V_{P2}$, thereby allowing the air-fuel ratio corresponding to the pump-driving current to be read. In step 204, the pump-driving current is calculated back from the air-fuel ratio read out, and if this pump-driving current is within a predetermined range, the failure flag is reset in step 206. If the current is less than the predetermined value, the failure flag is set in step 205. This is based on the fact that if the performance of the wide range air-fuel ratio sensor 80 deteriorates, its impedance increases for the constant voltage $V_{P1}$, as shown by a dotted line in FIG. 6, and it becomes difficult for the pump-driving current $I_P$ to flow. The operation then proceeds to step 207 wherein the pump-driving voltage is changed to a normal value $V_{P2}$, thereby allowing the air-fuel ratio to be detected. If that driving state is decided not be suitable for detecting any deterioration of the wide range air-fuel ratio sensor 80 in steps 201 and 202, as mentioned above, the operation proceeds to step 207. Next, in step 108, a decision is made as to whether or not it is normal in accordance with the state of the failure flag, that is, whether it has been set or reset.

As described above, according to the present invention, the pump-driving current is set to a predetermined value lower than the normal control value in the steady driving condition in which the air-fuel ratio is within a predetermined range. And any deterioration or failure of the wide range air-fuel ratio sensor is then detected when the pump-driving current is lower than a predetermined value, thereby suspending feedback control. Thus, deterioration of the engine performance and exhaust gas quality, and stalling of the engine due to the improper feedback control that would result from abnormal outputs due to such deterioration or failure of the wide range air-fuel ratio sensor can be avoided.

Having described preferred embodiments of the invention, it will be apparent to those skilled in the art that many changes and modification may be made without departing from the concepts of the invention.

What is claimed is:

1. An air-fuel ratio control apparatus for an internal combustion engine, said apparatus including a wide range air-fuel ratio sensor, which includes an oxygen sensor section for generating a voltage in accordance with the difference between atmospheric pressure and the oxygen concentration of the engine exhaust gas and an oxygen pump section for flowing a pump-driving current so as to attain said voltage at a predetermined value, an air-fuel ratio detecting device for providing an air-fuel ratio detecting signal in response to said pump-driving current, and a control section for feedback-controlling a mixed gas generation means in accordance with said air-fuel ratio detecting signal to obtain an air-fuel ratio having a required value, said apparatus further comprising a deterioration detecting means for detecting any deterioration or failure of the wide range air-fuel ratio sensor by detecting that the pump-driving current is lower than a predetermined value when the pump-driving voltage for flowing the pump-driving current is set to a predetermined value lower than the ordinary pump-driving voltage while the engine is running in a steady condition at which time the air-fuel ratio is within a predetermined range, and a feedback suspension means for stopping the feedback control of the air-fuel ratio when such deterioration or failure of the wide range air-fuel ratio sensor is detected.

2. A method of controlling the operation of an air-fuel ratio control apparatus for an internal combustion engine, said apparatus comprising a wide range air-fuel ratio sensor which includes an oxygen sensor section for generating a voltage in accordance with the difference between atmospheric pressure and the oxygen concentration of the engine exhaust gas and an oxygen pump section for flowing a pump-driving current so as to attain said voltage at a predetermined value, an air-fuel ratio detecting device for providing an air-fuel ratio detecting signal in response to said pump-driving current, and a control section for feedback-controlling a mixed gas generating means in accordance with said air-fuel ratio detecting signal to obtain an air-fuel ratio having a required value, said method comprising the steps of:

setting the pump-driving voltage for flowing the pump-driving current to a predetermined value lower than the normal pump-driving voltage while the engine is being driven in a steady condition under which the air-fuel ratio is within a predetermined range;

detecting whether or not the pump-driving current is lower than a predetermined value; and suspending the feedback control of the air-fuel ratio when the pump-driving current is lower than the predetermined value.

* * * * *